US005813510A

United States Patent [19]

Rademacher

[11] Patent Number: 5,813,510

[45] Date of Patent: Sep. 29, 1998

[54] CURRENCY AND COIN-ACTIVATED DROP SAFE

[75] Inventor: Darrell G. Rademacher, New Port Richey, Fla.

[73] Assignee: XCP, Inc., Dryden, N.Y.

[21] Appl. No.: 760,495

[22] Filed: Dec. 5, 1996

[51] Int. Cl.[6] ..... G07F 7/04

[52] U.S. Cl. ..... 194/206; 194/217; 235/379

[58] Field of Search ..... 194/206, 207, 194/217; 235/379; 705/35, 39, 44

[56] References Cited

U.S. PATENT DOCUMENTS

| | | | |
|---|---|---|---|
| 2,805,675 | 9/1957 | Noyes . | |
| 2,840,265 | 6/1958 | Noyes | 221/9 |
| 4,070,564 | 1/1978 | Tucker | 364/405 |
| 4,150,740 | 4/1979 | Douno | 194/206 |
| 4,235,491 | 11/1980 | Koerber et al. | 312/223 |
| 4,251,867 | 2/1981 | Uchida et al. | 705/39 |
| 4,611,286 | 9/1986 | Nishimura et al. | 364/405 |
| 4,733,765 | 3/1988 | Watanabe | 194/206 |
| 4,817,041 | 3/1989 | Sakamoto | 364/405 |
| 4,953,086 | 8/1990 | Fukatsu | 364/408 |
| 5,023,781 | 6/1991 | Yamato | 364/405 |
| 5,233,167 | 8/1993 | Markman et al. | 235/375 |
| 5,315,510 | 5/1994 | Kimura et al. | 364/405 |
| 5,366,404 | 11/1994 | Jones | 453/2 |
| 5,695,038 | 12/1997 | Keith et al. | 194/206 |

*Primary Examiner*—F. J. Bartuska
*Attorney, Agent, or Firm*—Trapani & Molldrem

[57] ABSTRACT

A point-of-sale drop safe and change making mechanism employs a cash drop drawer that is movable between open and closed positions and receives money, when the cash drop drawer is open. When the cash drop drawer is closed the cash drops into receptacle in drop safe. A currency acceptor accepts and registers paper currency bills and a money dispensing mechanism in the cabinet dispenses coins in a plurality of denominations into receptacle or tray located on the exterior of the cabinet. A money selection arrangement includes a plurality of user-actuable coin select keys or switches that are disposed on the exterior of the cabinet. The keys correspond respectively to coin denominations, e.g., key #1 dispenses dollar coins, key #2 dispenses quarters, etc. A controller board coupled to the currency acceptor, the money select mechanism, and the money dispensing mechanism obtains and stores an escrow amount or money credit amount when paper currency is inserted into the currency acceptor. The user actuates the money dispenser to dispense coins in selected denominations, and the control mechanism decrements the escrow or credit amount. The drop safe can also have a bill-dispensing mechanism. The arrangement can also be configured to change money from the currency and coins of one country to that of another. In that case, the escrow amount is automatically converted from the value in one country's funds into that of the other.

8 Claims, 4 Drawing Sheets

CURRENCY AND COIN-ACTIVATED DROP SAFE

BACKGROUND OF THE INVENTION

The present invention relates to money handling devices for use, e.g., at or near a point of purchase, and is especially directed to a secure device for changing money from one denomination to another or for changing from one system of currency to another. The invention is also concerned with an improved drop safe for retail locations that is capable of replenishing the supply of small bills and/or coins for making change, and which can account for money-changing transactions. The invention is further concerned with devices for converting money from one country's currency (and coins) to that of another country, e.g., for converting cash in Canadian currency to an equivalent amount of cash in U.S. funds.

In a typical small retail establishment, such as a fast food or convenience store, opening for business involves setting up a cash drawer in the cash register or similar point-of-sale device. This process is known as Opening Cash Drawer. This requires opening a safe and taking out cash to fill a cash drawer of the cash register. During this process, the store is vulnerable to theft and shortages. Then, during the sales day, it often occurs that a customer will tender a large bill, e.g., $50 or $100, for a small transaction, such as a newspaper, a few gallons of gasoline, or a pack of cigarettes. It is common practice for small retail establishments to maintain a maximum of no more than $50 in the cash drawer in order to avoid severe losses from theft or robbery. Consequently when the customer tenders a $50 or $100 bill, the cash drawer is not capable of supporting a return of change for the transaction. This means that either the store must have a policy of not accepting large bills, or else the store employee has to have access to a cash box. The latter case again makes the store vulnerable to robberies, as well as employee theft or "skimming".

Another problem is the daily need for continued replenishment of the cash drawer in currency and coins of various denominations. The retail store has to maintain a cash drawer at a given capacity to make change during the day to support an expected level of customer transactions. Access to change requires an expensive machine to discharge preset measured dispensed rolls of coins or bank notes by input of personal identification numbers (PINs) via a keypad, key, or card, or by giving the employees access to the safe where coins and currency are stored. Many business owners and managers presently favor using a small cash box or money bag that is kept in back of the sales counter to maintain small quantities of coins and bank notes to replenish the cash drawer during the business day. However, this means of storing cash leaves the store vulnerable to employee theft and makes the store a tempting target for armed robbery.

Another problem that arises for such businesses is the accumulation of excessive coins and currency bills. Large quantities of bills are usually shifted to a location under the cash tray in the cash drawer, and later placed in a drop safe or cash box/cash bag. This is done generally at a scheduled time, such as on the hour, or at any other time when large quantities of cash have accumulated in the cash drawer. Here, there is no accounting mechanism, and this procedure often results in employee theft, or what is know as "skimming". Also, large accumulations of cash in the cash drawer again make the store a tempting target for armed robbery, which can result in injury or even death to employees or customers.

In addition, at the end of the business day or at the end of a particular shift, the business owner or manager has to deal with the problem of Closing Cash Drawer. The coins and paper currency have to be counted and placed in a drop safe or in the standard safe of the business. Some business owners or managers actually take the closing cash home with them or carry it to a bank night deposit facility. Shortages and skimming can occur during the counting process, and of course the owner or manager with large amounts of cash on his or her person is again vulnerable to robbery, which often includes violence. Also, allowing the employee that closes the store to open the safe invites further losses by theft or shortages.

A still further problem is accountability for the cash that moves between the cash drawer and the drop safe or cash box/cash bag. During the business day, access to additional cash can results in employee shortages or actual theft and there is no mechanism to account for who was handling the cash when the loss occurred. There have been many attempts to deal with this problem, such as cash control sheets, keypad or card activated bulk roll dispensers, safes with electronic identification and time controls, and multiple locked cash drawers. Some dispenser machines have an audit tape to show the time and date, amount dispensed, and the PIN numbers of the person(s) who dispensed the cash. Unfortunately, these methods have proven unreliable and inaccurate due to lack of security through PIN number entry or card access.

The drop safes that are usually found in convenience stores are simple locking cabinets with a rotating slotted cylinder on top. When there is an accumulation of excess cash in the cash drawer, the cash is placed in the slot in the cylinder, and then the cylinder is rotated by hand. The cash falls into a bin inside the safe, and then the cylinder rotates back to the original position. However, if the employee at the cash register needs additional cash, it is not unusual for him or her to unlock the drop safe to obtain currency and coins to make change for a customer. In fact, some employees leave the drop safe unlocked simply to make it more convenient for making change and replenishing various denominations in the cash drawer. Either procedure defeats the purpose of having a safe in the first place.

There do exist change maker machines that dispense bulk coins automatically when paper currency (e.g. $5.00 or $10.00) is inserted, e.g., dispensing a roll of forty quarters when a ten-dollar bill is inserted. These machines are usually associated with vending machines. However, a machine intended to solve the specific needs of the fast food or convenience store, or other small retail establishment, and which can provide automatic changing of cash on demand, simply has not yet appeared.

A further problem has been observed at small convenience stores and similar establishments which use drop safes and change makers. In many such places, keypads and LCD displays are mounted in plain sight, often on a bracket near the change maker or simply hung in front of the change maker or drop safe. The keypad and LCD are in view of anyone entering the store, and this signals to potential thieves that there is access to the safe or change maker with a keypad.

In border towns near the Mexican or Canadian borders there arises another problem in selling merchandise to Mexican or Canadian nationals who have only their own country's currency or coins. In many locations, rather than accept foreign currency, many establishments turn customers away, and this results in lost sales of food, gasoline, or other services or merchandise. The reverse often happens when an American wants to make a purchase at a Canadian or Mexican retail establishment. In an ideal situation, the customer should be able to exchange one country's currency for the other's on the spot simply by placing the appropriate amount of bills and coins into an automatic machine, and obtaining the corresponding amount of bills and coins of the other country's currency at the then-prevailing exchange rate. However, no such machine has been available for this purpose.

A number or electronic cash registers and similar systems have been proposed for dealing with the problem of excess cash in the cash drawer or for obtaining coins or currency when needed for making change. There are several patents that are concerned with equipment for automated or semi-automated handling of money, including currency or notes. Fukatsu Pat. No. 4,953,086 relates to a currency exchange machine that exchanges dollars for yen and vice versa. The machine accepts paper currency and also dispenses it, and furthermore permits the customer to use a bank card for making the transfer. However, the machine is capable only of transactions in multiples of, e.g., $10.00 or of 10,000 Yen. Uchida et al. U.S. Pat. No. 4,251,867 relates to a currency exchange apparatus which requires an operator to enter the amount of money to be exchanged on a key pad or register, and then computes the foreign currency amount and pays out in the second currency. Koerber et al. U.S. Pat. No. 4,235,491 describes a money safe in which bundles of bills of different denominations are made available. The availability is on an elapsed time basis, that is, drawer closures are locked against movement and can be lifted out only after an elapsed time. Tucker U.S. Pat. No. 4,070,564 is directed to an anti-theft cash register, with the equipment including a cash register section, a keyboard section, and a coin changer. In order to limit access to the cash, the register accepts payments and makes change inside a cash vault, and the machine does not have a cash drawer. Jones U.S. Pat. No. 5,366,404 describes a cash register with a cash-drawer accounting system, which incorporates customer change-making and transaction recording. There is no provision for safeguarding excess cash. Kimura et al. U.S. Pat. No. 5,315,510 concerns a cash register which alarms when the money in the cash drawer exceeds a predetermined maximum amount. Yamato U.S. Pat. No. 5,023,781 also concerns an electronic cash register and in this case the machine uses a key card to open the register and identify the individual cashier. The card cannot be used outside a predetermined cashier shift time, so as to prevent unauthorized use. Markman et al. U.S. Pat. No. 5,233,167 relates to a multi-function point-of-sale machine, but does not address safeguarding excess cash or obtaining currency or coins for making change. Douno U.S. Pat. No. 4,150,740 concerns a money exchange machine in which there are stacks of notes of various denominations, and these are dispensed to the customer. This does not involve exchanging any foreign currencies. Nishimura et al. U.S. Pat. No. 4,611,286 relates to a cash register with a cash accounting system with pay-out control. The cash register has a cash dispenser that is controlled by a data transfer control circuit, for automatically keeping track of what amount of money of various denominations is available in the cash register. Sakamoto U.S. Pat. No. 4,817,041 relates to an electronic cash register that calculates the minimum units of currency that the operator should use to make change for a customer. Noyes U.S. Pat. Nos. 2,840,265 and 2,805,675 each relate to mechanical money handling systems, e.g., for dispensing rolls of coins or rolls of paper currency. Nothing in any of these prior proposals solves the problem facing small retail operators, as addressed above, and none of these proposals solves the problems faced by retail establishments and their customers at border locations where currency must be conveniently, accurately, and speedily exchanged so the customer can make a desired purchase.

OBJECTS AND SUMMARY OF THE INVENTION

Accordingly, it is an object of the present invention to provide a secure and simple-to-use drop safe and change making apparatus that overcomes the drawbacks of the prior art.

It is another object to provide a secure, simple-to-use arrangement for exchanging currency of one country for a desired amount of currency and/or coin of a second country.

It is a further object to provide apparatus that can securely store excess cash at a retail establishment, and permit exchange of large bills, e.g., $20, $50, or $100, for smaller bills and coins when needed for making change or for replenishing the cash drawer.

It is a still further object to provide such apparatus with accounting capability, and to make it possible to utilize the same without having to open the secure cabinet.

It is yet another object to provide secure apparatus for making an exchange of currency from the money of one country into coins and paper currency of another country in an amount needed to make a purchase.

In accordance with an aspect of this invention, a point-of-sale drop safe and change making mechanism employs a secure lockable cabinet having a lockable door, an interior, and an exterior, and a cash drop that is movable between open and closed positions and includes means for receiving money, when the cash drop is in its open position, for storage in the secure locking cabinet, and for releasing said money, when the cash drop is in its closed position, into a cash drop receptacle in the interior of the secure locking cabinet. A currency acceptor disposed in the interior of said secure locking cabinet accepts and registers paper currency bills by means of an acceptor slot accessible through a penetration in the secure locking cabinet. A money dispensing mechanism disposed in the interior of the secure locking cabinet contains a supply of coins of a plurality of denominations. A receptacle or tray is located on the exterior of the secure locking cabinet, for coins dispensed from the supply. A dispensing arrangement takes the coins from the supply and dispenses them from the supply through a penetration in the locking cabinet to the receptacle or tray. A money selection arrangement includes a plurality of user-actuable coin select keys or switches that are disposed on the exterior of the cabinet. The keys correspond respectively to coin denominations, e.g., key #1 dispenses dollar coins, key #2 dispenses quarters, etc. A control mechanism in the interior of the cabinet is coupled to the currency acceptor, the money select mechanism, and the money dispensing mechanism. The control mechanism obtains and stores an escrow amount or money credit amount in response to insertion of paper currency into the currency acceptor. This enables the coin select switches, so that the user can cause the money dispenser to dispense coins in selected denominations. As this occurs, the control mechanism decrements the escrow or credit amount. The drop safe can also have a bill-dispensing mechanism, for example, for dispensing $5 or $10 bill when paper currency of a larger denomination, such as $50, is inserted into the currency acceptor. The point-of-sale drop safe and change making mechanism preferably also incorporates accounting means disposed in the interior of the secure locking cabinet for recording the time and amount of each transaction involving insertion of currency into said currency acceptor and dispensing of money from the money dispensing mechanism. In a preferred embodiment, the accounting means produces a printed paper tape record of each said transaction.

Preferably, the cash drop is in the form of a drawer that slides out from the secure locking cabinet to an open position and slides in to a closed position. A cash chamber receives money when the drawer is slid open, and drops the money into the cash drop receptacle when the drawer slides in to its closed position. The drawer preferably includes a display coupled to the control mechanism for displaying the money credit amount, i.e., escrow amount, during a change-making transaction.

In a preferred embodiment the accounting mechanism records, i.e., on a paper tape, the time and amount of each transaction involving insertion of currency into said currency acceptor and dispensing of money from the money dispensing mechanism. The drop slide drawer can includes a data entry pad coupled to the accounting mechanism for inserting identifying data, e.g., a PIN or card number when the user inserts money into the cash drop receptacle using the drawer.

The apparatus preferably also incorporates a coin acceptor for accepting coins of the various denominations, i.e., dollar coins, quarters, dimes, nickels, and pennies, through a penetration in the cabinet, and the insertion of these coins increases the escrow amount accordingly. The supply of coins for the coin dispensing mechanism includes a respective coin bin for each respective denomination. The coin acceptor can include means for directing the inserted coins into the respective bins. This facilitates replenishing the coin supply, and avoids having to unlock the secure cabinet more often than necessary.

According to another aspect of the invention, a foreign currency conversion machine is configured for converting currency and coins from a first country to an equivalent amount of currency and coins of a second country at an exchange rate that can be pre-set into the machine. The machine has a secure cabinet with a lockable door, an interior and an exterior. A currency acceptor disposed inside the cabinet accepts paper currency in a plurality of denominations from said first country through a penetration in said cabinet. A currency dispenser disposed inside cabinet holds a supply of paper currency in a plurality of denominations of the second country and dispenses same through a penetration in said cabinet. A coin dispenser disposed inside the cabinet for holds a supply of coins in a plurality of denominations of said second country and dispenses same through a penetration in the cabinet. A control mechanism, e.g., an electronic control circuit, is coupled to the currency acceptor, the currency dispenser, and the coin dispenser. The control mechanism registers a first escrow amount in response to insertion of paper currency of the first country into said currency acceptor, converts the first escrow amount into a second escrow amount based on the exchange rate for the two countries'currency, which has been preset therein, and then enables the currency dispenser and coin dispenser to dispense currency and coins of said second country. The latter are discharged in denominations up to the value of the second escrow amount, and as this occurs the control mechanism decrements the second escrow amount as the currency and coin dispensers discharge currency and coins. A display on the outside of the cabinet is coupled to the control mechanism and displays at least one, and preferably both of the first escrow amount and the second escrow amount, that is, the amount of money left to pay out on the machine.

An arrangement of user-actuated selector switches or keys is preferably disposed on the outside of the cabinet, and coupled to the control mechanism, to permit the customer or user to select any desired denomination of the second country's coins and currency up to the value represented by the second escrow amount. The currency conversion machine can preferably also incorporate a coin acceptor disposed inside the cabinet for accepting coins in various denominations from the first country. The coin acceptor is also operative to increment the first escrow amount in response to insertion of coins.

The above and many other objects, features, and advantages of this invention will become apparent from the ensuing description of a preferred embodiment, which should be considered in connection with the accompanying Drawing.

DETAILED DESCRIPTION OF THE PREFERRED EMBODIMENT

Figure 1:
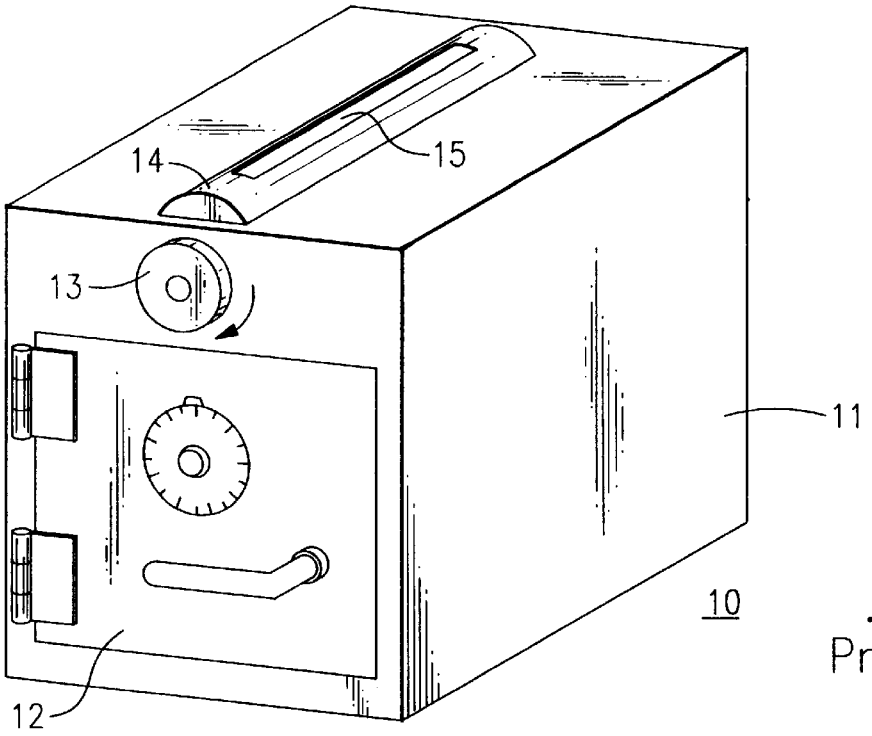
FIG.1 Prior Art
FIG. 1 is a perspective view of a conventional drop safe according to the prior art.

With reference now to the Drawing, FIG. 1 illustrates a typical drop safe 10 of the prior art, that is, the type of drop safe that is often used in convenience stores and which has the attendant problems as discussed previously. This conventional drop safe 10 has a basic security cabinet 11 with a locking door 12, usually with a combination lock. There is a drop cylinder 13 built into the top of the cabinet 11, which is rotated by hand by means of a knob 14 on the front of the drop safe. When there is an accumulation of cash or other valuables to be stored, the employee or attendant inserts the cash into a slot 15 on the top side of the cylinder 13, and then turns the knob 14. This rotates the cylinder 13 to an upside-down position, and the money drops out of the slot 15 into a tray or bin inside the safe 10. The drop safe mechanism of this type has no mechanism or means for accounting for any of the money that is put into the safe, and no mechanism to account for any money that is removed from the safe. For that matter, there is no way to make change from money in the safe without unlocking and opening the door 12. This means that either the employee on duty has to be able to unlock the safe, or else has to keep a stock of small bills and coins on hand outside the safe. In many stores, the safe is simply left unlocked most of the time to facilitate making change. It is apparent that any practice such as this significantly reduces the security value of the safe, and facilitates both robbery and "white collar" employee theft.

Figure 2:
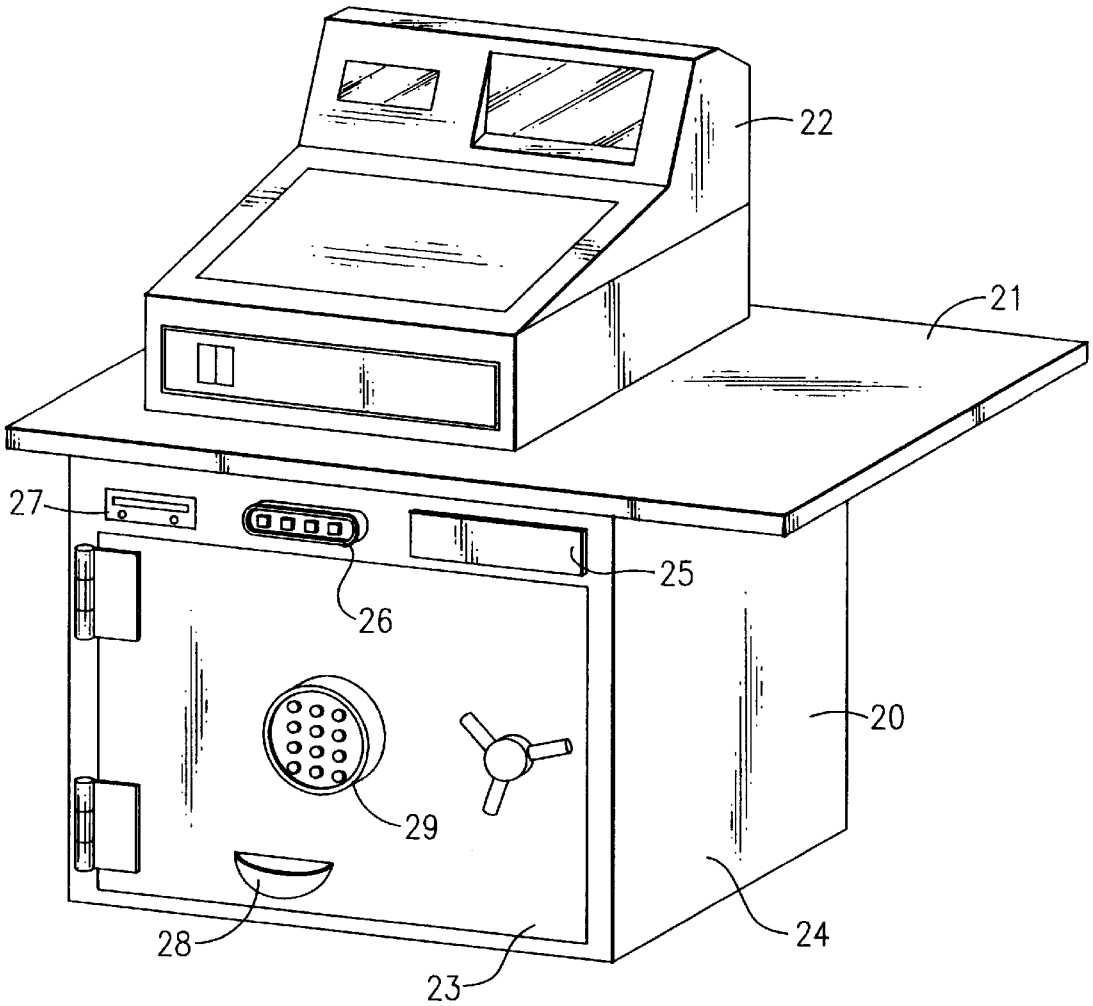
FIG. 2 is a perspective view of a coin and currency activated drop safe according to an embodiment of the invention, shown at a store counter with a cash register.
Figure 3:
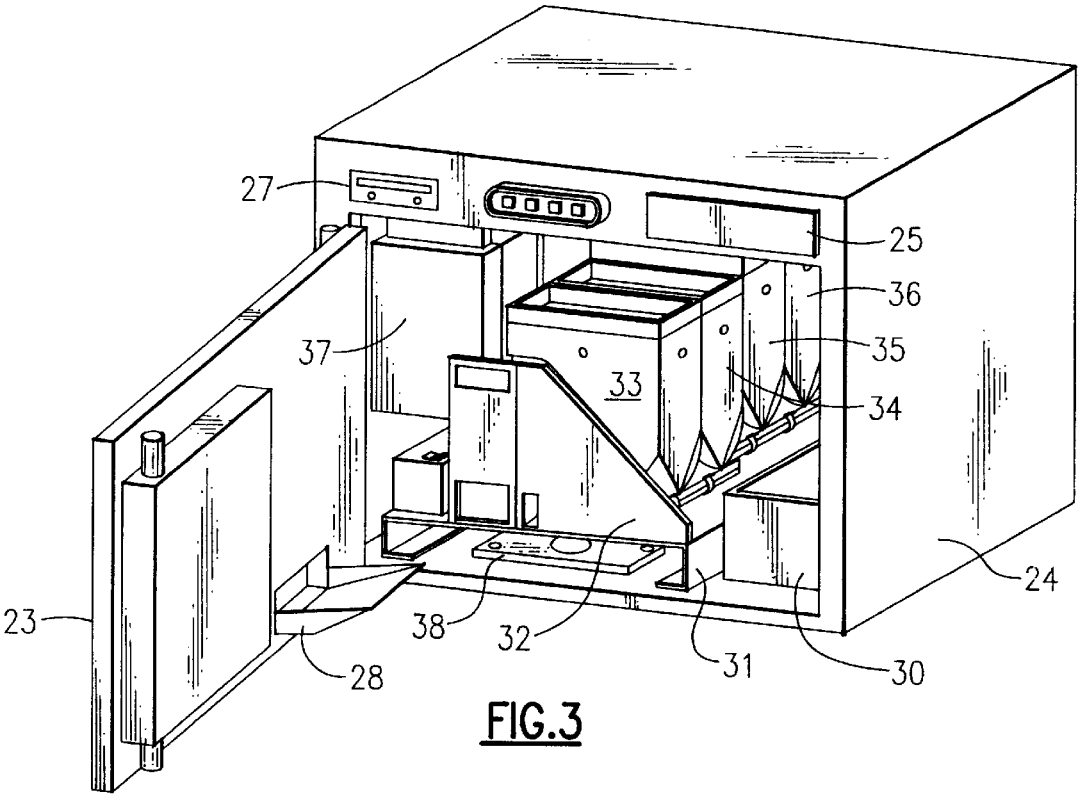
FIG. 3 is a front perspective of this embodiment, shown with the door open to view the cash and coin accepting and dispensing mechanisms.
Figure 4:
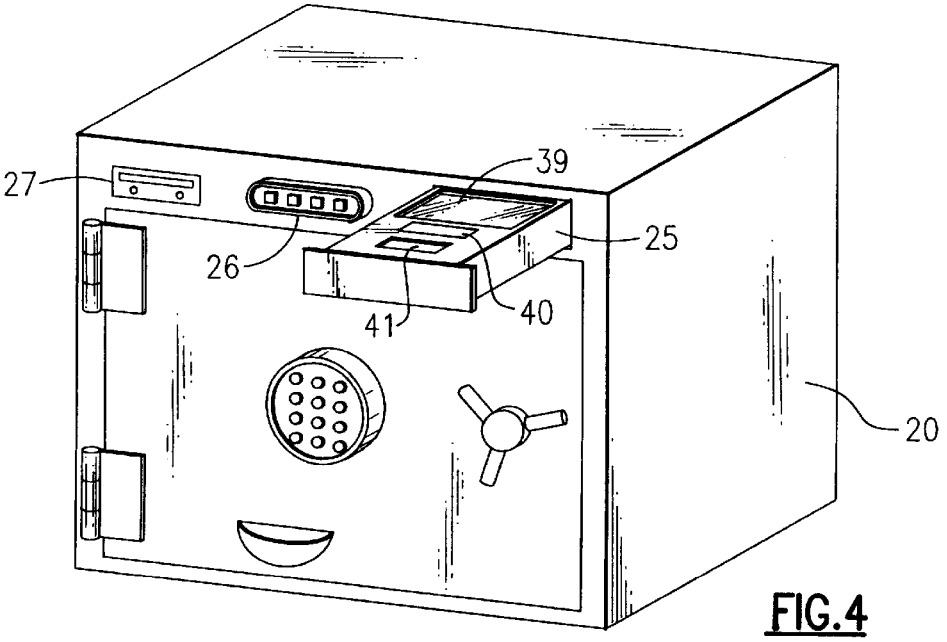
FIG. 4 is a front perspective of this embodiment, shown with the cash drop drawer extended.
Figure 5:
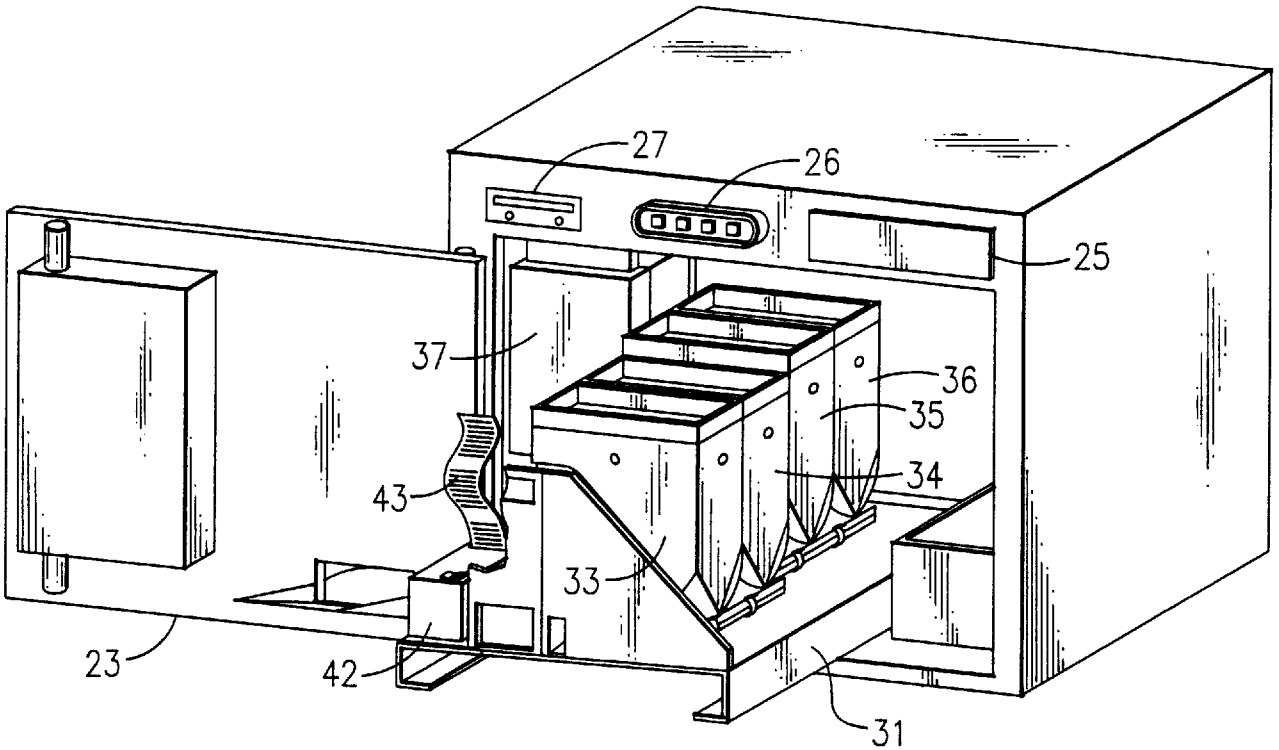
FIG. 5 is a front perspective view of this embodiment, shown with the door open and the coin-dispenser sliding shelf extended out and also showing the accounting mechanism.

A coin and cash-actuated drop safe 20 according to an embodiment of this invention is shown in FIGS. 2 to 5. As shown in FIG. 2, the drop safe 20 can be situated under a store counter 21 at a point of sale location, and preferably directly beneath a cash register 22. This facilitates quick and convenient storage of large accumulations of cash and changing of large bills (e.g., $20 and $50 bills) by the clerk or other employee without having to open the safe and with full accountability. As shown in FIGS. 3, 4, and 5, the drop safe 20 has a locking front door 23 and secure cabinet 24, with a pull-out drop drawer 25 situated above the door 23. FIGS. 2 and 3 show the drawer pushed in, and FIG. 5 shows the drawer 25 pulled out for use either to insert an accumulation of cash into the safe or to make change.

Alongside the drop drawer is an array of selector keys 26. These will be described later, but they can be used either to select how change is to be dispensed or to select a mode in an accounting operation. For purposes of this embodiment, there are four keys or buttons, to selecting pennies (1¢), nickels (5¢), quarters (25¢), and dollar coins ($1.00), respectively.

To the left of the selector keys is situated a currency acceptor 27, which is capable of accepting paper currency in several denominations. Here, the currency acceptor 27 can take $5, $10, and $20 bills, and optionally can accept $50 and $100 bills. These devices are available from a number of manufacturers, and are capable of identifying authentic U.S. federal reserve notes and rejecting bills that are not authentic.

An output coin tray or cup 28 is disposed on the door 23 and receives the coins that are discharged by the coin and currency actuated drop safe 20. Also shown on the door 23 is a coded entry key pad 29 for locking and opening the door 23. This can have a built-in time lock provision.

FIG. 3 shows the drop safe 20 with the door 23 opened to expose the mechanisms inside the security cabinet 24. A receptacle tray or bin 30 is situated beneath the drop safe drawer 25 to receive money or other valuables that are inserted into the safe by means of the drawer 25. On a slide-out shelf 31 is mounted a coin dispensing mechanism 32, which includes a plurality of bins or hoppers, including in this embodiment four bins, with a bin 33 for dollar coins, a bin 34 for quarters, a bin 35 for nickels, and a bin 36 for pennies. Any bill can be changed from some combination of these four coin denominations. However, the mechanism 32 may optionally include an additional dispenser for dimes (10¢), and/or a dispenser for paper currency denominations, e.g. $5 bills. The latter dispenser can take any of a variety of forms, and can dispense, e.g., rolled bills or single or multiple bills from a stack. The mechanism 32 can accommodate up to eight bins or hoppers, and can also accommodate a currency dispenser.

A bill stacker 37 is shown in position behind the currency acceptor for receiving and stacking the currency that is inserted by the clerk into the currency acceptor 27.

Finally, disposed beneath the slide-out shelf 31 is a controller board 38, which is electrically coupled to the currency acceptor 27, keys 26, drop drawer 25, and coin dispensing mechanism 32. This controller board receives signals from the currency acceptor, which it stores as an escrow amount to indicate the amount or value of the currency that is deposited into the currency acceptor 27. Then, as money is dispensed by the coin dispensing mechanism 32, the escrow amount is decremented by the value of the dispensed coin or currency. The controller board is also coupled to a printing accounting mechanism, to be described later.

FIG. 4 shows the currency or coin actuated drop safe 20 in condition to conduct an operation, that is, with the door 23 closed and locked, and with the drop drawer 25 pulled out to an open position.

As shown here, a receptacle 39 in the drawer 25 is open at the upper side to receive an accumulation of cash, a traveler's check, or other valuable item. When the drawer 25 is closed, the receptacle opens at its underside, so that the cash or other item drops into the receptacle tray 30. There is also an LCD screen 40 on the drawer 25, to display e.g. the amount of money deposited into the currency acceptor 27 and the amount of money value in escrow during a change making operation.

A large bill can be change for coins by the clerk or attendant without having to open the safe and without having to keep funds outside the safe. For example, if a customer pays for a small item, e.g., a candy bar (less than one-dollar value) with a twenty dollar bill, the clerk can obtain change from the drop safe 20, and avoid using up all the small bills and coins in the cash register 22 just to make change for this customer. The clerk can simply pull out the drawer 25 and insert the $20.00 bill into the currency acceptor 27. At this point the escrow value of $20.00 appears on the LCD screen 40. An associated key pad 41 can also be located on the drawer 25 near the LCD screen 40. Then the clerk depresses the first one of the keys 26 so that the unit dispenses dollar coins. As each coin is dispensed, the escrow value decreases by one dollar. Rather than simply change the twenty-dollar bill into twenty dollar coins, the clerk can depress others of the keys to discharge quarters, nickels or pennies. Preferably, the controller board has a mechanism to limit the number of coins that can be discharged while any one key 26 is being held down. For example, if the key for pennies is held down, the coin dispensing mechanism will dispense fifty pennies and then stop. If more pennies are needed, the clerk must release the key and press it again. Similarly, there is a limit of forty nickels or forty quarters for any one actuation of the respective selector key.

FIG. 5 shows the currency and coin actuated drop safe 20 with the door 23 opened and the shelf 31 pulled out for access to the coin dispensing mechanism 32. This position facilitates loading the respective coin hoppers 33, 34, 35, and 36, or otherwise servicing the equipment. Here shown to the left of the mechanism 32 is a printing accounting mechanism 42, whose functions are controlled by the buttons or keys 26 or by the key pad 41 when the door 23 is opened, and the unit is set into an accounting mode. The accounting mechanism produces a paper-tape record 43 of all transactions, which can include the amount, the time, and the employee identification number of the clerk that handled the transaction. In addition, the keys 26, key pad 41, and accounting mechanism 42 can also be used to enter and store data concerning deposits of excess cash and other valuables into the drop safe using the drop drawer 25 and receptacle 39. The accounting mechanism 42 is capable of accomplishing an electronic audit, and retains in memory the various metering totals for each denomination of cash inserted into the drop safe 20. The accounting mechanism 42 can print out data for an audit trail for each cash insertion, and the total escrow value, once the appropriate key selection is made on the key pad 41. The data output can be obtained electronically via a serial configurable data port of all meters for each denomination total inserted, each denomination value total dispensed, the time and date, and PIN access codes for each transaction, cash drop, opening cash drawer, or closing cash drawer. Also, the CPU of the controller board has the ability to store PIN codes used for access to the safe, for making drops of cash, for opening the cash drawer, and for closing the cash drawer drop at the end of a shift.

The concealed keypad 41 and the backlit LD screen 40, which are built in to the top surface of the drop drawer 25, are used to enter data and view transaction messages. With these items being out of sight to customers and others in the store, the temptation for robbery or other theft is significantly reduced.

The controller board 38 has a coin and bank note (paper currency) validation and counting system, coupled with the stacker 37 and coin mechanism 32, and with an optional coin acceptor (not shown here). These mechanisms accept coins and paper currency and send serial communications messages to a central processor on the board 38, which counts and escrows the total amount of cash inserted. This also accounts for the total amount of each type of or denomination of coin and paper currency that is inserted. In some embodiments, the coin mechanism only may be used, whereas in other embodiments, the paper currency acceptor only may be used, and in still others both may be used. In other possible embodiments of this invention, a credit card or stored value card is used as a means of entering a cash value. These totals of cash value entered are maintained in a non-volatile memory device, e.g., a FRAM. The total amount of cash inserted is displayed on the LCD screen 40 or on some other message display as an escrow amount. This display message is also available in ASCII format via a serial port so it can be transmitted, e.g., to a serial printer or to a host CPU, such as the point-of-sale CPU in the electronic cash register 22. The use of a production-manufactured keypad entry and time entry combination lock system, permits the keypad 29 to be also used for mode selection or coin dispensing selection, if desired. This avoids the requirement for other keypads or buttons. Alternatively, the currency and coin actuated drop safe 20 can operate from a separate keypad or buttons, e.g., at the electronic cash register 22, or can work with the keypads in parallel. The electrical interfacing required can be accomplished using diode isolation of signals, or using an analog-to-digital signal integrated circuit for use as a combination access and timed entry, and also for PIN identification of the clerk. This can also be used for selecting the values and denominations to be dispensed.

An opening cash drawer operation can be easily and securely accomplished, using the PIN identification of the opening clerk. The dispensed cash total can be stored and later produced in terms of coin and currency denominations, from the highest value down to the lowest value dispensed. The dispensed "cash drawer escrow total" can be configured to dispense after the employee's PIN is entered and followed by pushing the pound sign (#) key, for example. Coins and paper currency in the proper combination are then dispensed for the clerk, beginning with the largest denomination bills and ending with the smallest denomination coins.

The closing cash drawer operation is also accomplished easily, by inserting the cash in coins and bank notes or paper currency after keypad entry of the employee's PIN number, or else simply by allowing some period of time, e.g., ten seconds, to pass. This cash drop transaction is then recorded with the PIN, time, date, and amount inserted.

Figure 6:
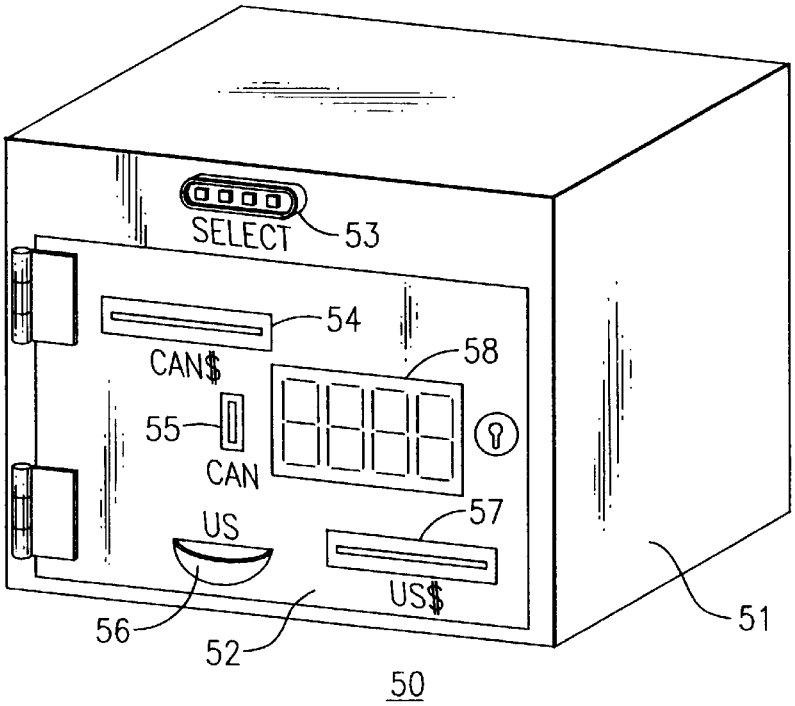
FIG. 6 is a perspective view of a currency and coin accepting and dispensing foreign exchange machine, according to an embodiment of this invention.

Another embodiment of this invention is shown in FIG. 6, which is here configured as a currency-exchange machine 50 for converting paper currency and/or coins of one country into paper currency and/or coins of another country. In this embodiment, the machine 50 converts Canadian money into U.S. funds, but in practice, the device could be configured for any country or countries. Here, the machine includes similar internal mechanisms to those of the drop safe 20 of the previous embodiment, e.g., the controller board, currency acceptor, and coin dispensing mechanism, as well as a printing accounting device. Here the machine includes a secure cabinet 51 with a locking front door 52 and a plurality of select buttons 53, similar to the keys 26 described above. A currency acceptor 54 accepts Canadian currency in the denominations that are used in that country, e.g., $2, $5, $10, and $20, and a coin acceptor 55 accepts Canadian coins in appropriate denominations, e.g., $1, 50¢, 25¢, 10¢, 5¢, and 1¢. In this embodiment there is a coin dispenser 56 (the dispensing tray of which is shown) for dispensing U.S. coins in denominations of $1, 25¢, 5¢, and 1¢. A currency dispenser 57 dispenses U.S. currency as $5 and $10 bills (in multiples of five dollars). An LCD escrow display 58 is positioned on the front of the machine, e.g., on the door 52. The pull-out drop drawer is omitted here, but could be included if desired.

The operation of the currency exchange machine can be explained with the following example. A Canadian visitor wishing to obtain U.S. funds deposits $24 (Canadian) in the form of a $20 (Canadian) bill and four one-dollar (Canadian) coins, depositing the same in the currency acceptor 54 and coin acceptor 55, respectively. The coin and currency acceptors produce the appropriate signals, and the controller board 38 registers an escrow amount of 24.00 (CANADIAN). The LCD display 58 then shows "24.00-CA "; this is automatically converted to a U.S.-funds escrow amount, based on a pre-programmed exchange rate. For this example, the exchange rate is preset at 0.731 (that is, one dollar Canadian equals 0.731 dollars U.S.). Preferably, the exchange rate will also show on the display 58. The LCD display 58 shows the escrow amount as "17.54 - US ". Using the select keys 53, the customer can select the denominations of U.S. currency and coins to be dispense. If no selection is made, the controller board will automatically select a default mode, in which the highest value denominations are dispensed first, depending on the available escrow value. In this example, the machine would first dispense a U.S. ten dollar bill (leaving an escrow amount of $7.54), then one five dollar bill (leaving an escrow amount of $2.54). Thereafter, the machine would dispense two one-dollar coins (i.e. "Susan B Anthony's"), then two quarters, and finally four pennies. By actuating the keys 53, the customer can obtain, e.g., seventeen dollar coins, ten nickels, and four pennies, if that is what is desired.

The controller board and escrow display can accommodate any value for the U.S. and foreign currency and coin amounts from one cent up to $999.99. The escrow amount can be converted to any cash value from, e.g. zero to two hundred percent of the escrow value.

If the customer inserts additional paper currency into the currency acceptor 54 or additional coins into the coin acceptor 55, then the escrow amount (as shown on the LCD display 58) will increase in terms of Canadian funds, and this will convert automatically into a new escrow amount in terms of U.S. funds. The exchange rate can be easily programmed, e.g., by PIN switch settings, and this can be done on a daily basis, or whenever the currency exchange machine 50 is opened to replenish the supplies of paper currency and coins. The currency exchange machine can be situated on a counter or in a wall at any store or shop, e.g., at or near a border crossing or airport, or anywhere that a traveler or tourist may need to make a quick and convenient exchange of one country's currency for another's. In this example, the exchange of currency is from Canadian into U.S., but the machine could of course be configured to convert money from U.S. into Canadian. The machine here is for a one-way conversion, but the machine could as well be configured to convert from each country's coin and currency into the other's. Also, the machine 50 can be configured for conversion between U.S. and Mexican funds, or between any countries'currencies. The machines can be optionally configured to accept paper currency only, or coins only, or to dispense paper currency only or coins only.

In either embodiment, a jammed-coin sensing circuit and software for the coin dispensing mechanism can detect jammed coins. The machine will continue to supply voltage to a stuck hopper for a predetermined time, such as three seconds, in an attempt to un-jam the stuck coin. After that, if unsuccessful, the stuck hopper will be shut down, and the display 40 or 58 will display "EMPTY" and the hopper number. The machine will then dispense coins from the next lower denomination to the value requested. In the event that this is also not possible, the machine will automatically shut down and display a message "OUT OF SERVICE". The nature of the problem will be displayed for the service attendant when the door to the safe or machine is opened, the program mode is activated. In the program mode, paper currency or coins can be inserted for testing purposes, without incrementing the internal register meters held in non-volatile memory. The units can have two sets of meters, with one set of resettable meters and another set being non-resettable.

The devices according to this invention can also be configured to be used with, or as a component of, and Automatic Teller Machine or ATM. This would provide, for example, the ability to obtain Canadian funds from a bank ATM by using an ordinary U.S. customer bank card.

While the invention has been described in detail with respect to certain preferred embodiments, it should be understood that the invention is not limited to those precise embodiments. Rather, many modifications and variations would present themselves to persons skilled in the art without departing from the scope and spirit of this invention, as defined in the appended claims.

I claim:

1. Point-of-sale drop safe and change making mechanism, comprising a secure lockable cabinet having a lockable door, an interior, and an exterior;

a cash drop that is movable between open and closed positions and includes means for receiving money, when the cash drop is in its open position, for storage in the secure locking cabinet, and for releasing said money, when the cash drop is in its closed position, into a cash drop receptacle in the interior of said secure locking cabinet;

a currency acceptor disposed in the interior of said secure locking cabinet for accepting paper currency bills and having an acceptor slot accessible through a penetration in said secure locking cabinet to accept and register paper currency bills inserted therein;

money dispensing mechanism disposed in the interior of said secure locking cabinet containing a supply of coins of a plurality of denominations, a receptacle for coins dispensed from said supply located on the exterior of said secure locking cabinet, and dispensing means for dispensing coins from said supply through a penetration in said secure locking cabinet to said receptacle for coins;

a money selection mechanism including a plurality of user-actuable coin select switches disposed on the exterior of said secure locking cabinet corresponding respectively to said coin denominations; and a control mechanism in the interior of said secure locking cabinet coupled to said currency acceptor, said money select mechanism, and said money dispensing mechanism, for storing a money credit amount in response to insertion of paper currency into said currency acceptor, enabling said coin select switches to cause said money dispenser to dispense said coins in selected denominations, and decrementing said credit amount as said money dispensing mechanism dispenses said coins.

2. Point-of-sale drop safe and change making mechanism according to claim 1, comprising accounting means in the interior of said secure locking cabinet for recording time and amount of each transaction involving insertion of currency into said currency acceptor and dispensing of money from said money dispensing mechanism.

3. Point-of-sale drop safe and change making mechanism according to claim 2, wherein said accounting means produces a printed paper tape record of each said transaction.

4. Point-of-sale drop safe and change making mechanism according to claim 1, wherein said cash drop includes a drawer that slides out from said secure locking cabinet to an open position and slides in to a closed position, and includes a cash chamber to receive money when said drawer is slid open and means to drop the money from said chamber into said cash drop receptacle when said drawer slides in to its closed position.

5. Point-of-sale drop safe and change making mechanism according to claim 4, wherein said drawer includes display means coupled to said control mechanism for displaying said money credit amount during a change-making transaction.

6. Point-of-sale drop safe and change making mechanism according to claim 5, wherein accounting means in the interior of said secure locking cabinet record time and amount of each transaction involving insertion of currency into said currency acceptor and dispensing of money from said money dispensing mechanism, and wherein said drawer includes a data entry pad coupled to said accounting means for inserting identifying data when the user inserts money into the cash drop receptacle using said drawer.

7. Point-of-sale drop safe and change making mechanism according to claim 1, further comprising a coin acceptor for accepting coins of a plurality of denominations through a penetration in said secure locking cabinet and which is coupled to said control mechanism to increment said escrow amount as coins are inserted into said coin acceptor.

8. Point-of-sale drop safe and change making mechanism according to claim 7, wherein said supply of coins includes a plurality of coin bins each holding coins of a respective denomination, and said coin acceptor includes means for directing coins inserted therein into the respective one of said bins.

* * * * *